US006357586B2

(12) United States Patent
Pratt et al.

(10) Patent No.: US 6,357,586 B2
(45) **Date of Patent: *Mar. 19, 2002**

(54) GOLF BALL HOLDER

(75) Inventors: Michael James Pratt, Draper; Joseph Novak, Salt Lake City, both of UT (US)

(73) Assignee: Ogio International, Bluffdale, UT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/576,622

(22) Filed: May 23, 2000

(51) Int. Cl.[7] ..... B65D 85/00; A45F 5/00

(52) U.S. Cl. ..... 206/315.9; 206/315.5; 224/191; 224/251; 224/919

(58) Field of Search ..... 206/315.1–315.9; 224/191, 251, 919

(56) References Cited

U.S. PATENT DOCUMENTS 3,777,933 A * 12/1973 Joliot ..... 206/315.9
3,968,522 A * 7/1976 Riess ..... 224/919
4,678,108 A * 7/1987 Inman ..... 224/919
4,798,319 A * 1/1989 James, Jr. ..... 224/919
5,186,374 A * 2/1993 Buxton ..... 224/191
5,641,103 A * 6/1997 Potik et al. ..... 224/251
D394,548 S * 5/1998 Lee ..... 206/315.9
5,772,090 A * 6/1998 Rodriguez ..... 206/315.9
5,839,631 A * 11/1998 Hebert et al. ..... 206/315.9
6,003,747 A * 12/1999 Lee ..... 206/315.9
6,029,850 A * 2/2000 Pate et al. ..... 206/315.9

* cited by examiner

*Primary Examiner*—Luan K. Bui
(74) *Attorney, Agent, or Firm*—Kirton & McConkie; Michael F. Krieger

(57) ABSTRACT

A golf ball holder is disclosed that holds a plurality of golf balls, each golf ball being independently removable from the holder without the need to remove one of the other balls first. The holder can be attached to a golf bag either permanently or temporarily. The holder is made from a flexible fabric with openings at a first end and a second end. Golf balls are slipped into the holder from either end. The golf balls are fitted within a location where an opening is made in the holder. The opening allows the user to see whether a ball is available as well as the type of ball. The opening can stretch to allow the user to remove the golf ball through the opening rather than through one of the end openings. The openings where the golf balls are held can also be large enough to insert a golf ball into the holder. The holder can be sewn to an outside portion of the golf bag, typically near the top for easy access. The holder can be attached via a hook and eye attachment means, such as Velcro, or with clips or buckles, or a combination of either. In one embodiment, the holder has room to hold three golf balls, each ball having its own opening to show whether a ball is within the holder and what type of ball it is. Further, the ball holder is made of neoprene in one embodiment, but can also be made from other durable materials that can stretch and compress in order to hold the balls securely in place.

21 Claims, 4 Drawing Sheets

GOLF BALL HOLDER

THE BACKGROUND OF THE INVENTION

The present invention relates generally to golf equipment and more particularly, to a golf ball holder that attaches to or is mountable to a golf bag, golf cart, belt, or the like for ready access and retrieval of a golf ball.

Golfing is a very popular recreational and social sport that provides enjoyment to millions of participants. Golf is typically played at a leisurely pace that allows golfers to talk, visit, and enjoy the beauty of the course being played. One problem that occurs in golf is that golf balls are often lost during play and a replacement ball must be found to continue play. Most golf bags have pockets in which golf balls are stored for play. Unfortunately, the player must stop playing, reach deep into such a bag, and try to select a desired ball to be used. Further, many golfers are very partial to the type or brand of golf ball to be played and often hunt within the bag to find the right ball.

One solution to provide ready access to a preferred ball has been to use a ball clip that holds one or more golf balls with a clasp or lip within either a cup or support member or detent location. The golf ball slips into the cup or between the clasp and the support in a secured position. Unfortunately, the clasp can break over time and the cup portions may crack, making the ball holder useless. Other types of holders include hard plastic cylinder tubes or fabric tubes that have at least one opening at one end with a clip of some sort that keeps the balls within the tube. The cylinder tubes may also include a mechanical holder to hold the golf balls within the tube. Unfortunately, the mechanical holder can break, which would prevent the ready removal of a desired golf ball. Also, the tube holders present for use only one ball at a time.

SUMMARY OF THE INVENTION

According to the present invention, a golf ball holder is disclosed that holds a plurality of golf balls, each golf ball being independently removable from the holder without the need to remove one of the other balls first. The holder can be attached to a golf bag either permanently or temporarily. The holder is made from a flexible fabric with openings at a first end and a second end. Golf balls are slipped into the holder from either end. The golf balls are fitted within a location where an opening is made in the holder. The opening allows the user to see whether a ball is available as well as the type of ball. The opening can stretch to allow the user to remove the golf ball through the front opening rather than through one of the end openings. The front openings where the golf balls are held can also be large enough through which a golf ball can be inserted into the holder. The holder can be sewn to an outside portion of the golf bag, typically near the top for easy access. The holder can be attached via a hook and eye attachment means, such as Velcro, or with clips or buckles, or a combination of either. In one embodiment, the holder has room to hold three golf balls, each ball having its own opening to show whether a ball is in the space behind the opening and what type of ball it is. Further, the ball holder is made of neoprene in one embodiment, but can also be made from other durable materials that can stretch and compress in order to hold the balls securely in place. These fabrics include nylon, stretch polyester, stretch cotton, or the like. Alternatively, the holder can be made from a non-stretch material where the balls are stored, but have elastic closures wherever an opening exists, such as at each end and at the ball locations. The elastic closures allow a ball to be viewed and removed at the holding site without having to remove any other balls first.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF SPECIFIC EMBODIMENTS

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 4, is not intended to limit the scope of the invention, as claimed, but is merely representative of the specific embodiments of the invention.

The specific embodiments of the invention will be best understood by reference to the drawings, wherein like parts are designated by like numerals throughout.

Figure 1:
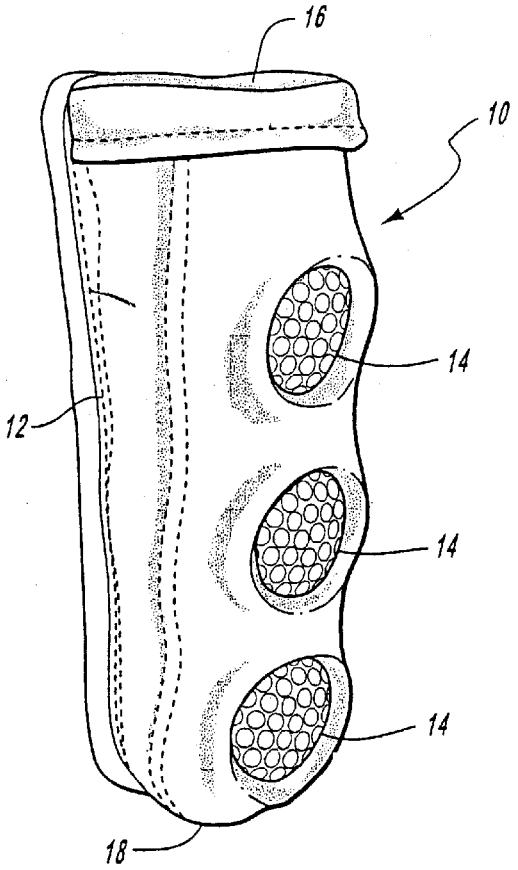
FIG. 1 depicts a golf ball holder in accordance with the present invention.
Figure 2:
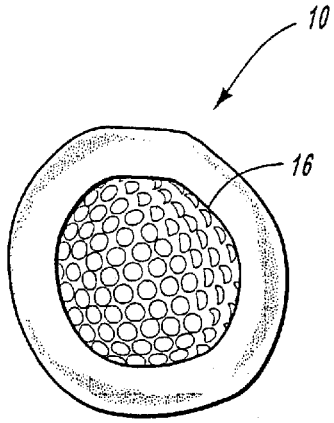
FIG. 2 illustrates an end view of the golf ball holder in accordance with the present invention.

The ball holder apparatus or carrier is depicted in FIGS. 1 and 2. A holder 10 with an inside diameter less than that of a golf ball (approximately 1.75 in.) is constructed from an appropriate fabric. In this example, holder 10 is fabricated of fabric-lined closed cell neoprene and formed from a rectangular piece joined with a sewn seam 12 to form a sleeve. The holder 10 can hold three golf balls and is approximately 5 inches long. Holder 10 also has three openings 14 approximately one inch in diameter and two openings 16, 18 at either end, which openings are smaller than the diameter of the sleeve. Openings 14 allow for the user to identify what type of ball is stored in holder 10 or to view whether a ball is in the holder. The openings are generally circular, but oval, square, rectangular, triangular, or other desired geometric shapes are permissible.

Since holder 10 is made of elastic neoprene, the balls may be inserted into the holder by pushing them into the opening 16, 18 at either end. Further, the balls may be inserted through openings 14. When the ball is pushed though an opening, the opening stretches to allow the ball to enter or exit. Since each ball is placed in its own location with its own opening, it can be readily removed through that opening without needing to remove any adjacent balls for access. The elastic nature of the neoprene stretches enough to allow the ball to pass. The neoprene grips each ball once inside holder 10 and compresses enough to hold each ball. Optionally, one or both ends 16, 18 can be closed.

Figure 3:
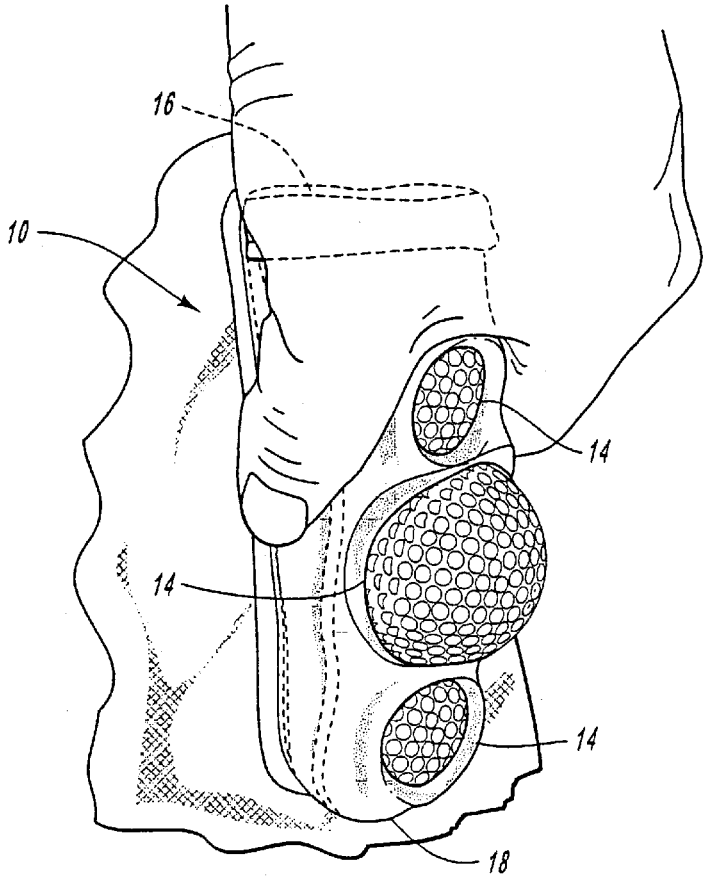
FIG. 3 illustrates the removal of a golf ball from the holder of FIG. 1 in accordance with the present invention.

A ball is removed from holder 10 by squeezing the neoprene fabric behind the ball opposite its own opening 14. As shown in FIG. 3, the pressure exerted forces the ball outward through opening 14. The shape of holder 10 distorts and stretches to allow the ball to pass. Once the ball clears opening 14, it is expelled into the user's hand and the other balls are left undisturbed in their original positions within holder 10.

Figure 4:
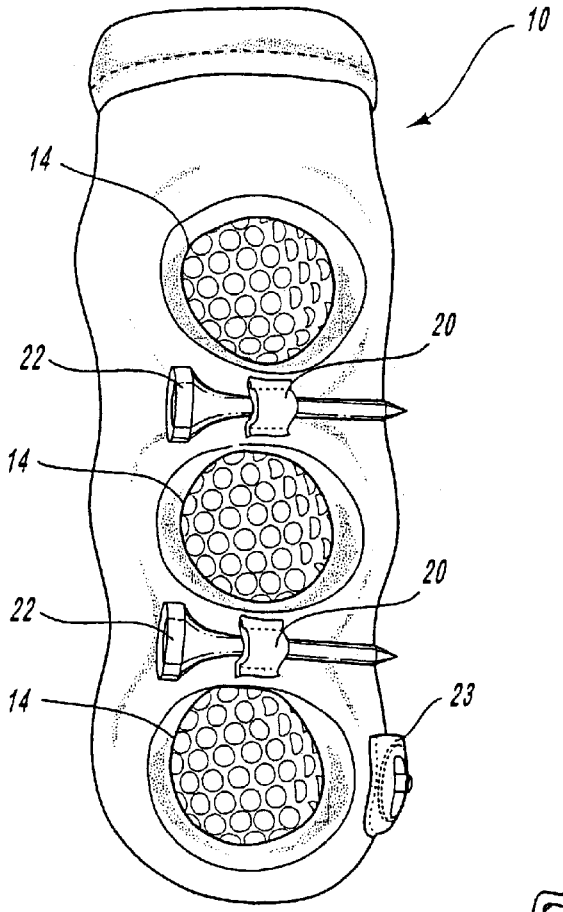
FIG. 4 illustrates an alternative embodiment of the golf ball holder in accordance with the present invention.
Figure 5:
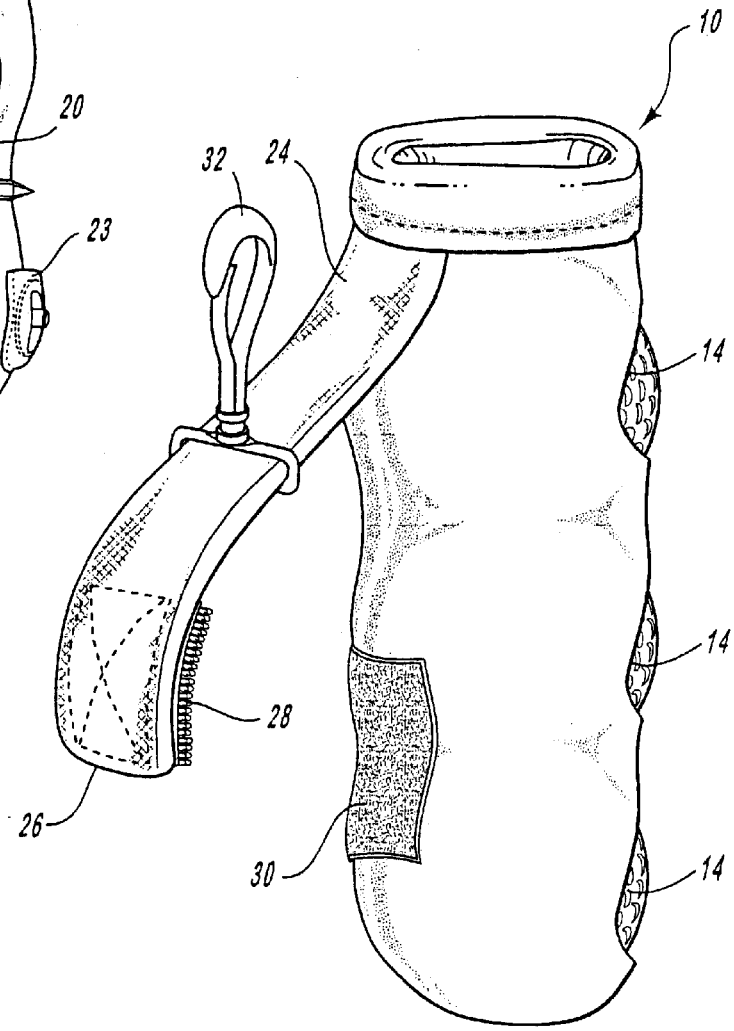
FIG. 5 depicts yet another embodiment of the golf ball holder in accordance with the present invention; and, FIGS. 6 and 7 depict the golf ball holder as attached to a golf bag in accordance with the present invention.
Figure 6:
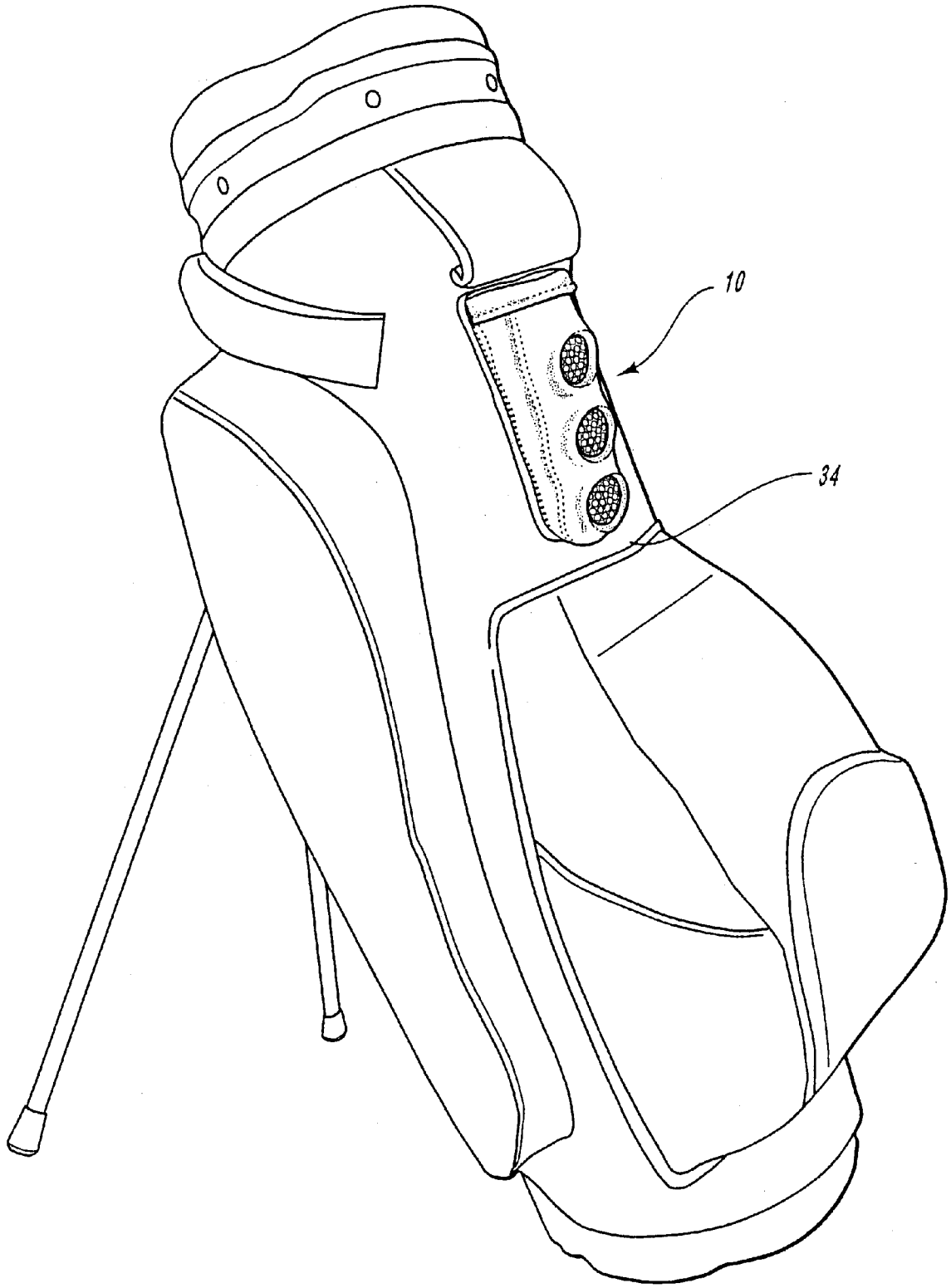

The holder 10 can be sewn onto a golf bag as a permanent attachment to the golf bag 34 as shown in FIG. 6. The holder can be enhanced by adding useful features, as shown on FIGS. 4 and 5. A strip of elastic fabric 20 attaches around the outside of the holder 10 to hold a plurality of golf tees 22 as shown in FIG. 4.

A band portion 23 may be attached to form a pocket in which a ball marker may be stored. A hole in the band 23 will accommodate the extension piece in a spike-type marker, and a flat marker will be snugly retained by the band.

A belt loop, clip or other convenient carrying mechanism may be incorporated into the holder 10, rather than sewing the holder onto the golf bag. One example is shown in FIG. 5. A length of nylon web strapping 24 is sewn at one end to the outside surface of holder 10. The free end 26 of strapping 24 has a fastening mechanism such as a snap or a Velcro hook and loop fastener strip 28. A receiving counterpart 30 of the fastening mechanism, such as a matching Velcro strip, is attached to the holder, allowing the formation of a belt loop with the strapping. The closable loop thus formed may be attached to a variety of locations, including the handle of a golf cart or the rim of the steering wheel of a self-propelled golf cart. An optional clip 32 may be attached to strapping 24, offering additional ways that the holder may be attached to the golf bag, golf cart or golfer.

Figure 7:
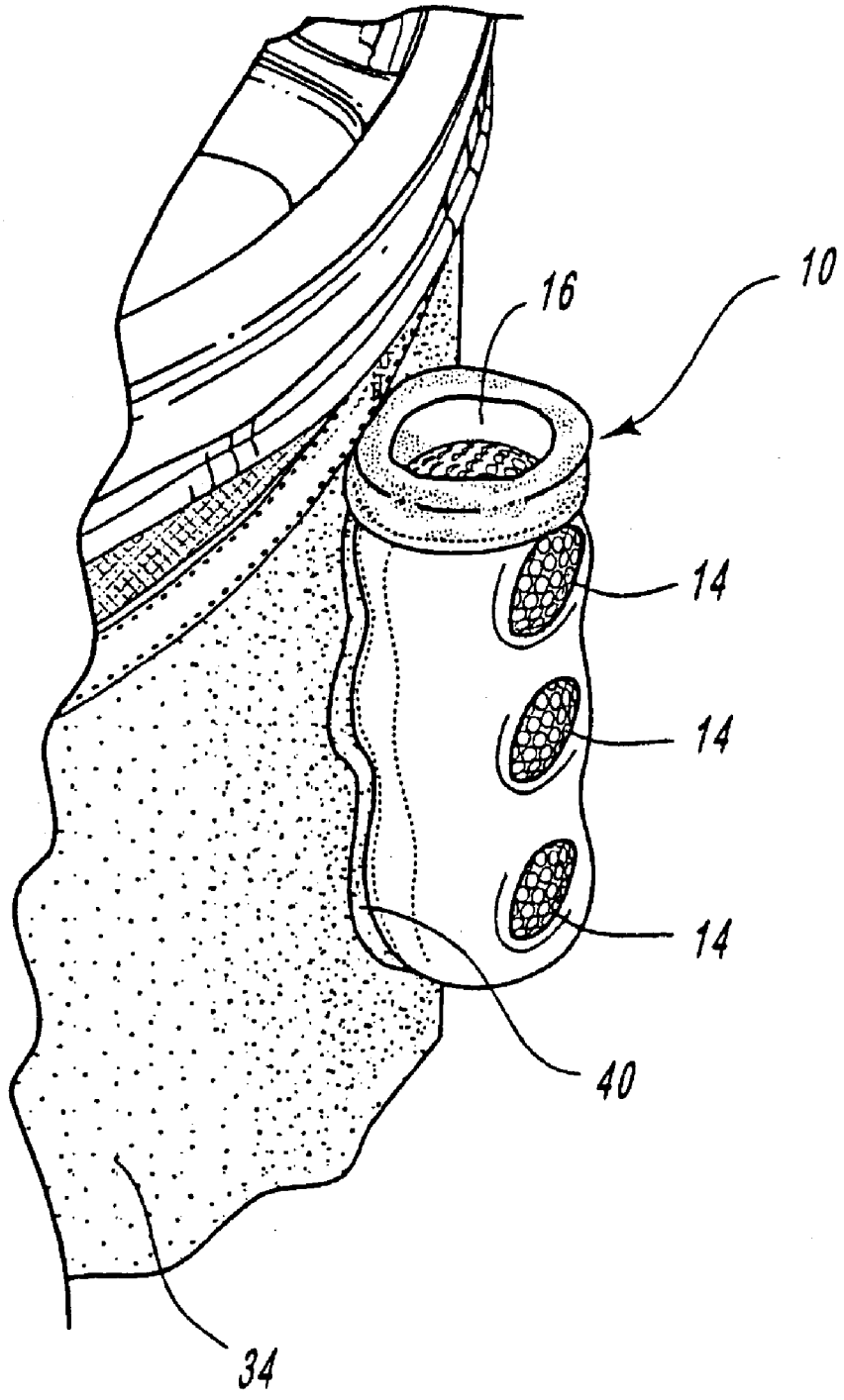

FIGS. 6 and 7 illustrate the golf ball holder 10 as attached to a golf bag 34. Specifically, FIG. 7 illustrates attachment means 40 showing the golf ball holder 10 attached along its length to golf bag 34. In the figure golf ball holder is sewn to golf bag 34. Also shown is opening 16, wherein a golf ball is seen within golf ball holder 10.

FIGS. 6 and 7 illustrate the golf ball holder 10 as attached to a golf bag 34. Specifically, FIG. 6 illustrates the golf ball holder 10 attached along its length to golf bag 34. In FIGS. 6 and 7, golf ball holder 10 is sewn to golf bag 34.

The present invention may be embodied in other specific forms without departing from its spirit or essential characteristics. For example, alternative materials such as vinyl-back denier taffeta, fabric-lined foam rubber, or a canvas shell with dense cotton padding. Other materials include stretch cotton fabric or nylon. With the taffeta or canvas, or other non-stretchable fabric, the openings at either end are stabilized and reinforced with standard nylon webbing fabric trim stitched to the fabric. The holder can be designed to hold more than three golf balls, such as 10 or more. Other attachment means include a buckle and latch. A pocket or a second circumferential elastic band could be incorporated for holding a score card, pencil, divot fixer, spike cleaner, ball brush, or other small items. A clip or ring could be attached at the top and bottom to accommodate an adjustable carrying strap, permitting the device to be worn over the shoulder or across the chest. The scope of the invention is, therefore, indicated by the appended claims, rather than by the foregoing description. All changes which come within the meaning and range of equivalency of the claims are to be embraced within their scope.

What is claimed is:

1. A golf ball holding apparatus capable of holding a plurality of golf balls and configured to be associated with a golf bag, the apparatus comprising:

a holding sleeve having two ends and an exterior sidewall, the sleeve having a plurality of openings formed in the sidewall, the openings being smaller than the diameter of the golf ball, each of the openings being elastic to allow immediate access to a golf ball and viewing of each of the golf balls, the immediate access allowing each golf ball to pass through the opening for either insertion and retention in or removal from the apparatus without having to remove an adjacent golf ball, wherein the holding sleeve comprises a flexible material; and attachment means for attaching to a golf bag, along its length, the exterior sidewall of the holding sleeve, the attachment means allowing the golf bag to bias the plurality of golf balls contained within the holding sleeve toward their respective openings for easy removal and insertion of a golf ball, the attachment means allowing a user to remove a golf ball with one hand by pinching the holding sleeve behind the golf ball and pulling on the holding sleeve perpendicular to the golf bag until the golf ball is removed from its respective opening, the attachment means allowing the user to insert a golf ball into any of the openings with one hand by forcing the golf ball toward the golf bag through the opening.

2. The golf ball holding apparatus according to claim 1, wherein the flexible material includes neoprene.

3. The golf ball holding apparatus according to claim 1, wherein the holding sleeve is sewn onto a portion of the golf bag.

4. The golf ball holding apparatus according to claim 1, wherein the attachment means is a hook and loop fastener.

5. The ball holding apparatus according to claim 1, wherein the attachment means is a clip.

6. The ball holding apparatus according to claim 1, wherein the attachment means provides removable attachment to the golf bag.

7. The ball holding apparatus as recited in claim 1, wherein one end of the apparatus is closed to prevent passage of a golf ball therethrough.

8. The ball holding apparatus as recited in claim 1, wherein both ends of the apparatus are closed to prevent passage of a golf ball there through.

9. A golf bag and a golf ball holder, the golf ball holder being capable of holding a plurality of golf balls, the holder comprising:

a holding sleeve having a first end and a second end and a diameter less than that of a golf ball, the sleeve having a plurality of openings smaller than the diameter of the golf ball and the sleeve diameter, the plurality of openings formed along the sides and at least one of the first end and second end of the sleeve, each opening being elastic to allow immediate access to a golf ball and viewing of each ball, the immediate access allowing each ball to pass through the opening for either insertion and retention in or removal from the holder without having to remove an adjacent golf ball, wherein the holding sleeve comprises a flexible material; and attachment means that attaches the golf ball holder to the golf bag, the attachment means allowing the golf bag to bias the golf balls contained within the golf ball holder by providing attachment of the golf ball holder to the golf bag along the length of the golf ball holder, wherein a user may remove and insert a golf ball into the golf ball holder with one hand due to the biased presence of the golf bag on the golf balls, the golf ball removed and inserted through the opening in a direction perpendicular to the golf bag.

10. The golf bag according to claim 9, wherein the flexible material includes neoprene.

11. The golf bag according to claim 9, wherein the holder is permanently attached to the golf bag.

12. The golf bag according to claim 9, wherein the holding sleeve is sewn onto a portion of the golf bag.

13. The golf bag according to claim 9, wherein the holder attaches to the golf bag via at least one of:

(i) a clip; and (ii) a hook and loop fastener.

14. The golf bag according to claim 9, wherein the holder further includes at least one opening on either end of the sleeve.

15. A golf ball holding apparatus capable of holding a plurality of golf balls and configured to be associated with a golf bag, the apparatus comprising:

a holding sleeve having a first end and a second end, and a side, the sleeve having a plurality of openings smaller than the diameter of a golf ball, the plurality of openings being formed along the side of the sleeve and at least one of the first and second ends of the sleeve, each opening being elastic to allow immediate access to a golf ball and viewing of each ball, the immediate access allowing each ball to pass through the opening for either insertion and retention in or removal from the apparatus wherein the golf ball is removed or inserted without disturbing or removing any other golf ball within the apparatus, wherein the holding sleeve comprises a flexible material; and attachment means for attaching, along its length, the exterior sidewall of the holding sleeve to a golf bag, the attachment means allowing the golf bag to bias the plurality of golf balls contained within the holding sleeve toward their respective openings for easy removal and insertion of a golf ball, the attachment means allowing a user to remove a golf ball with one hand by pinching the holding sleeve behind the golf ball and pulling on the holding sleeve perpendicular to the golf bag until the golf ball is removed from its respective opening, the attachment means allowing the user to insert a golf ball into any of the openings with one hand by forcing the golf ball toward the golf bag through the opening.

16. The golf ball holding apparatus according to claim 15, wherein the flexible material includes neoprene.

17. The golf ball holding apparatus according to claim 15, wherein the holding sleeve is sewn onto a portion of the golf bag.

18. The golf ball holding apparatus according to claim 15, wherein the attachment means includes one of:

(i) a hook and loop fastener; and (ii) a clip.

19. The golf ball holding apparatus according to claim 15, wherein the attachment means provides permanent attachment to the golf bag.

20. The golf ball holding apparatus according to claim 15, wherein the attachment means provides removable attachment to the golf bag.

21. A golf ball holding apparatus capable of holding a plurality of golf balls, the apparatus comprising:

a holding sleeve permanently attached, along its length, to a golf bag and having an open upper end and a closed lower end, the sleeve having at least one opening situated in the exterior sidewall and between the open upper end and the closed lower end, the attachment allowing the golf bag to bias a golf ball contained within the holding sleeve toward an opening of said at least one opening situated in the exterior sidewall, the opening in the sidewall being smaller than the diameter of a golf ball and smaller than the open upper end and being elastic to allow immediate access to and viewing of a golf ball, the opening in the sidewall allowing the golf ball to pass through for insertion and retention in and removal from the apparatus, wherein the holding sleeve comprises neoprene.

* * * * *